United States Patent [19]

Benedikt et al.

[11] Patent Number: 4,798,991

[45] Date of Patent: Jan. 17, 1989

[54] SURFACE-GAP SPARK PLUG FOR INTERNAL COMBUSTION ENGINES

[75] Inventors: Walter Benedikt, Kornwestheim; Gerhard Heess, Tamm; Werner Herden, Gerlingen; Karl-Hermann Friese, Leonberg; Helmut Reum, Stuttgart; Jürgen Schmatz, Mundelsheim; Siegbert Schwab, Sindelfingen, all of Fed. Rep. of Germany

[73] Assignee: Robert Bosch GmbH, Stuttgart, Fed. Rep. of Germany

[21] Appl. No.: 55,891

[22] PCT Filed: Sep. 13, 1986

[86] PCT No.: PCT/DE86/00366

§ 371 Date: May 7, 1987

§ 102(e) Date: May 7, 1987

[87] PCT Pub. No.: WO87/01877

PCT Pub. Date: Mar. 26, 1987

[30] Foreign Application Priority Data

Sep. 17, 1985 [DE] Fed. Rep. of Germany ..... 3533124

[51] Int. Cl.[4] ..... H01T 13/38; H01T 13/52

[52] U.S. Cl. ..... 313/137; 313/131 R

[58] Field of Search ..... 313/131 R, 135, 136, 313/137, 138, 139

[56] References Cited

U.S. PATENT DOCUMENTS

| | | | |
|---|---|---|---|
| 2,657,248 | 10/1953 | Smits | 313/137 |
| 3,046,434 | 7/1962 | Schurecht | 313/131 |
| 4,695,758 | 9/1987 | Nishida et al. | 313/130 |

*Primary Examiner*—David K. Moore
*Assistant Examiner*—K. Wieder
*Attorney, Agent, or Firm*—Michael J. Striker

[57] ABSTRACT

A spark plug for internal combustion engines comprises a center electrode enclosed in an insulating body enclosed in a metal housing, and a ground electrode. The insulating body has an end portion which faces the combustion chamber. An electrical field develops, resulting in a surface spark gap between two electrodes on the surface of the insulating body at the end portion thereof. The insulating body is transversely divided into the upper portion and the lower portion, of which the lower portion facing the combustion chamber is made of a material having dielectric constant 5-50 times higher than that of the upper portion.

17 Claims, 6 Drawing Sheets

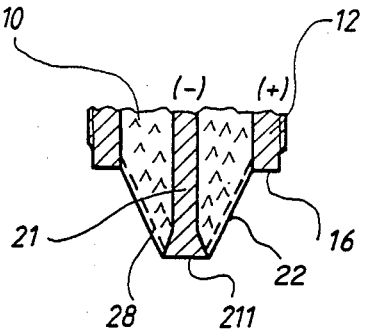
Fig. 10
Fig. 11
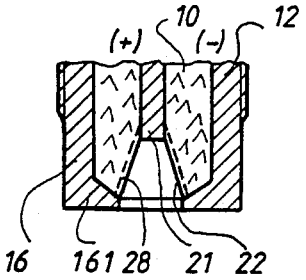
Fig. 12
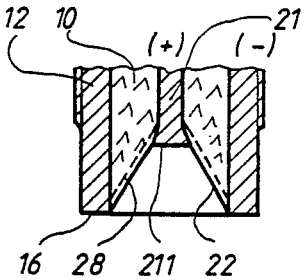

SURFACE-GAP SPARK PLUG FOR INTERNAL COMBUSTION ENGINES

BACKGROUND OF THE INVENTION

The invention relates to a spark plug having a surface spark gap for internal combustion engines.

In contrast to spark plugs having air spark-gaps, such surface-gap spark plugs are distinguished by a substantially lower ignition voltage requirement with reference to the electrode spacing. However, the ignition spark must be very rich in energy, so that there is still sufficient energy for igniting the fuel mixture despite cooling of the slide path. The greater is the burning voltage after the ignition of the surface spark gap, the greater this energy is in a given ignition system. The burning voltage, in turn, is directly dependent on the magnitude of the surface spark gap, that is, on the length of the slide path formed between the electrodes on the surface of the insulating body on the combustion chamber side. Of course, a larger surface spark gap, in turn, requires a greater ignition voltage than a small one.

SUMMARY OF THE INVENTION

It is an object of the invention to provide a spark plug for internal combustion engines, which has the advantage that at a given ignition voltage the slide path length of the surface spark gap can be substantially increased. As a result of the suggested construction of the free surface of the insulating body on the combustion chamber side and the arrangement of a so-called rear electrode behind the surface, which rear electrode forms the cathode and has a constant or variable distance from this surface and an angle of inclination relative to this surface, as desired, even 90°, a surface charge is formed along the surface of the insulating body during the voltage increase at the spark plug as a result of the dielectric displacement. This surface charge, which is in proportion to the field intensity as well as the relative dielectric constants (relative permittivity) of the surface material of the insulating body, effects an ignition voltage which is greatly reduced relative to the pure gas discharge and is hardly dependent on the compression. At the ignition voltages which are made available by the ignition systems conventionally used in motor vehicles today, slide path lengths in the centimeter region can be bridged by the ignition sparks with the spark plugs according to the invention. Since the burning voltage also increases along with the possibly large slide path length, it is very easy to transmit energy which is predominantly supplied to the gaseous fuel-air mixture over the long distance of the surface spark gap. The shape of the surface of the insulating body and the electrodes is optional within the scope of the teaching according to the invention. At a representative ignition voltage, it is advisable to construct the surface in such a way that the greatest possible slide path length is achieved in order to achieve the highest possible burning voltage.

At presently available ignition voltages, the energy delivered to the combustible fuel mixture by the spark plug, according to the invention, is approximately ten times as great as in a conventional spark plug. Conversely, there is a much lower ignition voltage requirement in the spark plug, according to the invention, with identical energy transmission to the fuel-air mixture.

The spark plug, according to the invention, can be used for a slide glow discharge with a burning period of milliseconds, as well as for a slide disruptive discharge with a burning period of nanoseconds. The erosion occurring in the disruptive discharge as a result of the very hot ignition spark on the surface of the insulating body on the combustion chamber side can be distributed symmetrically along the circumference, since the individual slide paths in this construction are lengthened by means of the erosion and the ignition spark always jumps over at the shortest slide path. Additional protection against erosion can be achieved by means of the construction of the surface of the insulating body on the combustion chamber side.

Such erosion damage is prevented in the slide glow discharge. In the spark plug, according to the invention, a high burning voltage is achieved (typically 1 kV), by means of which an efficiency of a degree virtually comparable to the slide disruptive discharge results during the energy transmission to the fuel-air mixture, since the heat losses caused by the poor heat conductivity of the insulating body and the outgoing energy at the electrodes (quenching losses) are very slight because of the large electrode spacing.

Since, as mentioned in the beginning. the formation of the surface discharge is benefitted as the relative permittivity of the insulating body work material increases, it is advisable to produce the insulating body from a work material with a higher relative permittivity. However, in so doing, the spark plug simultaneously acquires a relatively large capacity, which promotes the tendency toward a slide disruptive discharge. In order to ensure a slide glow discharge in spite of a high relative permittivity of the insulating material, it is advisable to construct the spark plug with a divided insulating body. The highly dielectric lower portion of the insulating body on the combustion chamber side promotes the development of a surface charge on the surface of the insulating body, which leads to a particularly low ignition voltage. However, the capacity of the spark plug is relatively low because of the two-piece construction of the insulating body; only its lower portion, which is smaller in volume, has the high relative permittivity, so that a hot disruptive discharge causing erosion is prevented. A breakdown at the point of separation may be prevented by means of the high-insulation dividing layer. An arc discharge after ignition is avoided by means of a resistance of approximately 1 kΩ in the supply line of the center electrode.

The invention is explained in more detail in the following description by means of the embodiment examples shown in the drawing.

BRIEF DESCRIPTION OF THE DRAWINGS

FIGS. 2 to 12 show a schematic view of the end portion of the spark plug in FIG. 1 on the combustion chamber side according to eleven different embodiments.

DETAILED DESCRIPTION OF THE PREFERRED EMBODIMENTS

Figure 1:
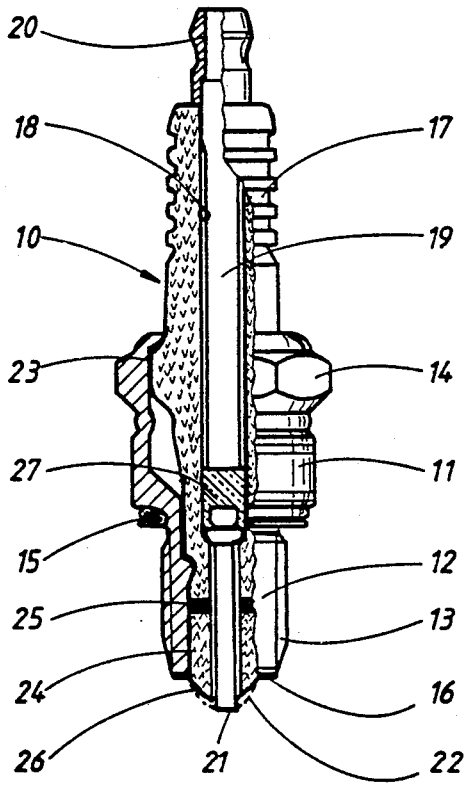
FIG. 1 shows a spark plug of an internal combustion engine, partly in section.
Figure 2:
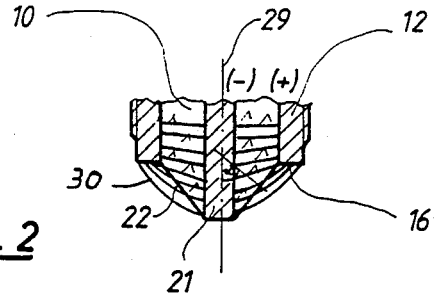
Figure 3:
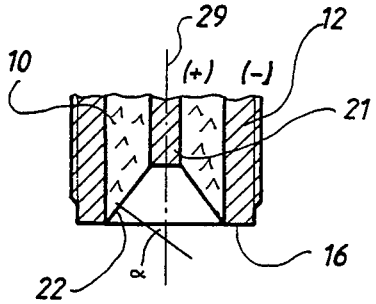
Figure 4:
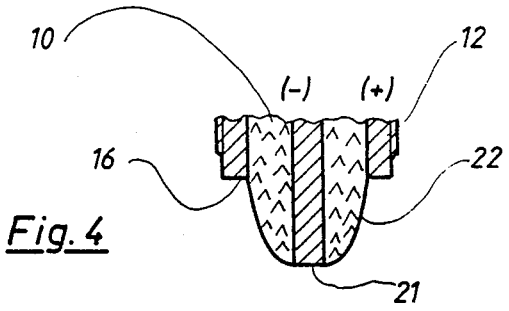
Figure 5:
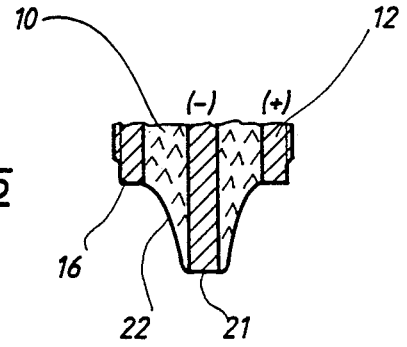
Figure 6:
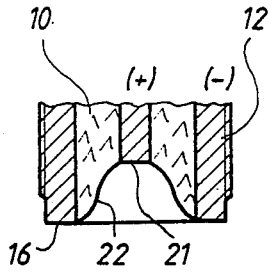

The spark plug shown in FIG. 1 for an internal combustion engine comprises an insulating body 10 which is symmetrical with respect to rotation and is enclosed on a longitudinal portion by a metal housing 11 which is likewise symmetrical with respect to rotation. On an end portion 12, which is reduced in diameter, the metal housing 11 carries a thread 13 by means of which the spark plug can be screwed into a cylinder head of the internal combustion engine. A wrench hexagon 14 serves for the screwing in. A sealing ring 15 provides for the gastight installation of the spark plug in the cylinder head. The metal housing carries an annular ground electrode 16 on the front side of its end portion 12 on the combustion chamber side, the end portion 12 being provided with the thread 13

The insulating body 10 comprises a plurality of annular grooves 17 on its surface as so-called leakage current barriers and is provided with a central axial through-borehole 18. A connection pin 19, which projects out of the insulating body 10 with a connection piece 20 at its end remote of the combustion chamber, and a center electrode 21, which extends from the end portion of the insulating body 10 on the combustion chamber side and is electrically and mechanically connected with the connection pin 19 by means of a glass-melt flux substance, 27, are located in the through-borehole 18. The front side of the center electrode 21 on the combustion chamber side is exposed. When high voltage is applied between the center electrode 21 and the ground electrode 16, a surface spark gap 26 develops between them, wherein the ignition spark sparks over along a slide path formed on the free surface 22 of the insulating body 10 on the combustion chamber side.

In the embodiment example of the spark plug seen in FIG. 1, the insulating body 10 is divided transversely in its end portion on the combustion chamber side and accordingly comprises an upper portion 23 on the connection side and a lower portion 24 on the combustion chamber side. The upper portion 23 is formed of aluminum oxide ($Al_2O_3$) with a relative permittivity $\epsilon_r$ of less than ten, while the work material of the lower portion 24 has a much greater relative permittivity, in this instance, approximately 50–500. There is a dividing layer 25 of silicon rubber, epoxy resin or glass in the dividing plane between the upper portion 23 and the lower portion 24. However, as in the known spark plugs, the insulating body 10 can also be constructed of one piece and, in this case, preferably be made of aluminum oxide.

Various embodiment forms of the construction of the end portion of the spark plug on the combustion chamber side are shown in FIGS. 2–12. In all of the embodiments, the surface 22 of the insulating body 10 is shaped in such a way that it is penetrated by a plurality of imaginary lines of flux 30 (FIG. 2) of the electrical field developing between the center electrode 21 and the ground electrode 16 when voltage is applied. In every embodiment, the electrode, which forms the cathode, or a portion of this electrode, is guided along behind the surface 22 at a distance from this surface 22 and at a desired angle of inclination relative to this surface 22, as seen in the direction of the course of the lines of flux. The spacing is optional. It can be constant or can vary along the surface 22. Because of its position "behind" the surface 22, this electrode is also called "rear electrode". The course of the lines of flux 30 is drawn schematically in FIG. 2 in a manner representative for all the drawings.

In the embodiment examples according to FIGS. 2, 4, 5 and 7–10, the electrode forming the cathode is formed by the center electrode 21, while in the embodiments according to FIGS. 3, 6, 11 and 12, the ground electrode 16 forms the cathode. In the individual drawings, the cathode is designated by (−) and the anode by (+). As can easily be seen from these drawings, a plurality of lines of flux proceeding from the annular front side of the ground electrode 16 (in the embodiments according to FIGS. 2, 4, 5 and 7–10) or from the front side of the center electrode 21 (in the embodiments according to FIGS. 3, 6, 11 and 12), penetrate the surface 22 at an acute or right angle and end in the cathode located behind the surface 22 at a distance from the latter. By means of these surface elements of the surface 22, which are placed diagonally or vertically relative to the electric lines of the flux, an electron charge is formed at the surface 22 during a voltage increase between the electrodes 16, 21 due to the dielectric displacement in the insulating body 10, which electron charge is proportional to the field intensity as well as the relative dielectric constants or relative permittivity of the insulating body 10. Because of this surface charge, the ignition spark can jump over between the electrodes 16, 21 at a much lower ignition voltage than is the case in a pure gas discharge or slide discharges which are not formed in this manner.

In the embodiments of the spark plug according to FIGS. 2–6 and FIGS. 9–12, the electrodes are arranged concentrically relative to one another, wherein their electrode walls extend parallel with respect to one another. The surface 22 of the insulating body 10 increases continuously from the anode (+) to the cathode (−) in all the embodiments, specifically in such a way that the normal lines of optionally small surface elements enclose an angle with the longitudinal axis 29 of the insulating body 10, or the longitudinal axis of the electrodes 16, 21, which is greater than 0° and is, at most, 90°. But the surface can also increase in a discontinuous manner.

In the embodiments according to FIGS. 2, 4, 5, 9 and 10, the center electrode 21 forming the cathode (−) projects far over the end of the ground electrode 16 forming the anode (+). In these embodiments, the end portion of the insulating body 10 is constructed in a cap-like manner, specifically in such a way that its longitudinal profile has a contour which increases linearly (FIGS. 2 and 9) or in a curve-shaped or arc-shaped manner (FIGS. 4, 5) from the ground electrode 16 to the center electrode 21. A steplike contour results when the surface increases in a discontinuous manner.

In the embodiment examples of the spark plug according to FIGS. 3, 6, 11 and 12, the end of the center electrode 21 forming the anode (+) is set far back from the annular end of the ground electrode 16 forming the cathode (−), and the end portion of the insulating body 10 on the combustion chamber side is constructed in a crater-like manner, specifically in such a way that flanks are developed which increase in the longitudinal profile from the center electrode 21 to the ground electrode 16 with a linear (FIGS. 3, 11 and 12) or curve-shaped or arc-shaped (FIG. 6) contour.

Figure 7:
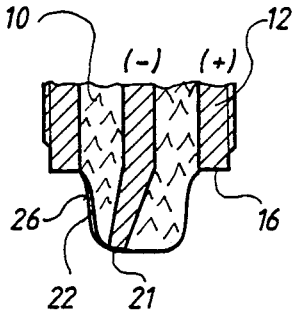

In the embodiment of the spark plug according to FIG. 7, the insulating body area of the center electrode 21 forming the cathode, which insulating body area projects over the annular ground electrode 16, is bent down relative to the portion of the center electrode which extends concentrically with the ground electrode 16. The ignition spark developing between the center electrode 21 and the ground electrode 16 is accordingly forced on a predetermined slide path as designated by 26 in FIG. 7.

Figure 8:
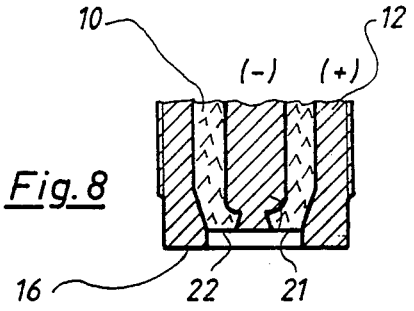
Figure 9:
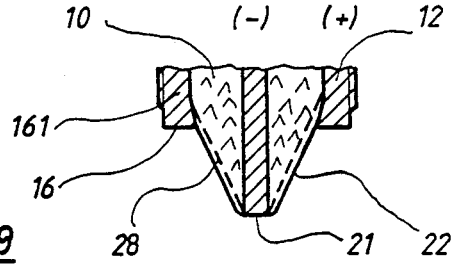

In the embodiment form of the spark plug according to FIG. 8, the surface 22 of the insulating body 10 on the combustion chamber side extends transversely relative to the longitudinal axis of the insulating body 10. The very broad center electrode 21, which passes into a very small web in the front end portion, produces a rear electrode which is also guided along behind the surface 22 and forms the cathode (−). The annular ground electrode 16 increases in diameter in the end area and projects somewhat over the surface 22 with its free annular surface. Here, also, the lines of the flux proceeding from the ground electrode 16 forming the anode (+) penetrate the surface 22 of the insulating body 10 on their way to the so-called rear electrode at an angle greater than 0°. Accordingly, the principle of construction described in the beginning is also realized in the embodiment form of the spark plug according to FIG. 8.

The slide discharge occurring in the described spark plug can be realized as a disruptive discharge in the nanosecond range or as a glow discharge in the millisecond range or as a combination of these discharge forms, according to the design of the combustion chamber. In the disruptive discharge, a capacitor is to be provided in the spark plug itself or in the plug of the spark plug. But spark plugs for disruptive discharge can also comprise an insulating body 10 constructed in one piece and made of a work material with a high relative permittivity. A series connected spark gap can also be provided in addition.

During the hot disruptive discharge, which can amount to several tens of thousands of degrees, the surface 22 of the insulating body 10 is melted and partially worn away (erosion) along the respective slide path which is developed. Therefore, it is provided that a uniform burnoff is effected along the entire surface. This is achieved with spark plugs according to the embodiments according to FIGS. 9–12. In these embodiments, the end portion 161 or 211 of at least one of the electrodes 16, 21 is constructed in such a way that the shortest distances between the electrodes 16, 22, as measured in the interfaces of the insulating body 10 which extend parallel to the surface 22, increase in the area of the end portions 161 or 211 as the spacing of the parallel interfaces from the surface 22 increases. The interfaces form the outer surface areas of a cone in the embodiments of FIGS. 2, 3, 9–12. Of the parallel interfaces, one interface 28 is drawn in a dashed line in FIGS. 9–12 in each instance. As can clearly be seen, the shortest distance between the electrodes 16, 21 measured along this interface 28 is increased during a burn-off of the surface 22 until the interface 28. At this location the slide path length between the electrodes 16, 21 increases as the burn-off on the surface 22 increases. Since the slide path having the shortest distance from the ignition spark is preferred, the ignition spark is shifted and a burn-off of the surface 22 is achieved so as to be uniform at the circumference.

Particular ceramic materials can serve as additional means for reducing the erosion of the surface 22 and, accordingly, lengthening the life of the spark plug. Ceramic materials having a small grain (less than 10 μm) and without pores have proven particularly resistant to burn-off. The materials taken into consideration are aluminum oxide ($Al_2O_3$), sapphire, silicon nitrite ($Si_3N_4$), quartz, zirconium oxide ($ZrO_2$), porcelain, pyrex, duran glass, etc. Materials with a higher relative permittivity ($\epsilon_r$=50–500) are preferred in order to improve the development of the surface discharge and the capacity required for the disruptive discharge. A preliminary treatment of the surface 22 by means of melting, e.g. through laser application or gas discharge, improves the resistance against erosion.

In order to achieve a slide glow discharge the spark plug must have the lowest possible capacity. When using high-dielectric materials for improving the surface discharge, the insulating body 10 has a two-piece construction, as described in FIG. 1. A series connected spark gap is possibly provided in the plug or in the spark plug. The slide glow discharge is a relatively cold discharge with respect to the physical characteristics of gas discharges, since the electrons are liberated from the electrode surfaces by means of ionic collisions and not thermally. An erosion of the surface 22 of the insulating body 10 does not occur.

We claim:

1. In a surface-gap spark plug for internal combustion engines, comprising an insulating body which has an end portion and carries a center electrode in said end portion which faces a combustion chamber side; a metal housing which partially encloses said insulating body, said metal housing carrying a ground electrode at an end thereof facing said combustion chamber side, said ground electrode annularly enclosing said center electrode at a distance therefrom, wherein an electrical field develops and a surface spark gap is formed between said center and ground electrodes along a slide path on a surface of said insulating body when voltage is applied between said electrodes, the improvement comprising said surface (22) of said insulating body (10) being shaped in such a way that it is penetrated by a plurality of lines of flux (30) of the electrical filed developing between said center and ground electrodes (16, 21), and at least a portion of one of said electrodes (16, 21) forming a cathode positioned behind said surface (22), as seen in the direction of the course of said lines of flux, with at least a constant spacing from and at a desired angle of inclination relative to said surface (22), said insulating body (10) being divided transversely and having an upper portion (23) formed of a material with relatively low dielectric constants, and lower portion (24) facing the combustion chamber side and carrying said surface and formed of a material with dielectric constants which are 5–50 times higher than that of said upper portion so as to promote a development of a surface charge on said surface.

2. Spark plug according to claim 1, wherein said electrodes (16, 21) comprise electrodes walls which extend parallel to one another and are arranged concentrically relative to one another, said surface (22) of said insulating body (10) being defined by a diameter which increases from the electrode which forms an anode to the electrode which forms the cathode in at least a continuous manner, and normal lines of optionally small surface elements enclose an angle ($\alpha$) with a longitudinal axis (29) of said insulating body (10), said angle being greater than 0° and being at most 90°.

3. Spark plug according to claim 2, wherein said center electrode (21) forming said cathode projects far over an end of said ground electrode (16) forming said anode, and the end portion of said insulating body (10) is formed in a cap-like manner in such a way that a longitudinal profile thereof has a linear contour which increases from said ground electrode (16) toward said center electrode (21).

4. Spark plug according to claim 2, wherein an end of said center electrode (21), which forms an anode, is offset far back with respect to an end of said ground electrode (16), which forms said cathode, and said end portion of said insulating body (10) being constructed in a crater-like manner in such a way that a longitudinal profile thereof has flanks which increase from said center electrode (21) toward said ground electrode (16) and which have a linear.

5. Spark plug according to claim 1, wherein at least one of said electrodes (16, 21) has an end portion (161, 211) formed in such a way that the shortest distance measured in an area of said end portion in interfaces (28) of said insulating body which extend parallel to said surface (22) of said insulating body (10) from said other electrode (21, 16) increases as a spacing of said interfaces (28) from said surface (22) increases.

6. Spark plug according to claim 1, wherein at least said surface (22) of said insulating body (1) consists of a non-porous ceramic material.

7. Spark plug according to claim 6, characterized in that said surface (22) is melted, by means of a laser application.

8. Spark plug according to claim 1, wherein a dividing layer (25) made of a material selected from the group consisting of silicon rubber epoxy resin and glass is arranged between said upper portion (23) and said lower portion (24) to prevent a breakdown at a plane of separation between said upper portion and said lower portion.

9. Spark plug according to claim 1, wherein a dividing plane between said upper portion (23) and said lower portion (24) is provided in said end portion of said insulating body (10) at a distance from said surface (22).

10. Spark plug according to claim 1, wherein a connection pin is provided, said center electrode being connected with said connection pin so as to be electrically conductive, and an electrical connection between said center electrode (21) and said connection pin (19) is formed so as to have high impedance with a resistance value in a kilo ohm range.

11. Spark plug according to claim 1, wherein a dividing plane between said upper portion (23) and said lower portion (24) is provided in said end portion of said insulating body (10) at a distance from said surface (22).

12. Spark plug according to claim 2, wherein said center electrode (21) forming said cathode projects far over an end of said ground electrode (16) forming said anode, and the end portion of said insulating body (10) is formed in a cap-like manner in such a way that a longitudinal profile thereof has a curve-shaped contour which increases from said ground electrode (16) toward said center electrode (21).

13. Spark plug according to claim 2, wherein said center electrode (21) forming said cathode projects far over an end of said ground electrode (16) forming said anode, and the end portion of said insulating body (10) is formed in a cap-like manner in such a way that a longitudinal profile thereof has a step-like contour which increases from said ground electrode (16) toward said center electrode (21).

14. Spark plug according to claim 2, wherein an end of said center electrode (21, which forms an anode, is offset far back with respect to an end of said ground electrode (16), which forms said cathode, and said end portion of said insulating body (10) being constructed in a crater-like manner in such a way that a longitudinal profile thereof has flanks which increase from said center electrode (21) toward said ground electrode (16) and which have a curve-shaped contour.

15. Spark plug according to claim 2, wherein an end of said center electrode (21), which forms an anode, is offset far back with respect to an end of said ground electrode, (16), which forms said cathode, and said end portion of said insulating body (10) being constructed in a crater-like manner in such a way that a longitudinal profile thereof has flanks which increase from said center electrode (21) toward said ground electrode (16) and which have an arc-shaped contour.

16. Spark plug according to claim 2, wherein an end of said center electrode (21), which forms an anode, is offset far back with respect to an end of said ground electrode (16), which forms said cathode, and said end portion of said insulating body (10) being constructed in a crater-like manner in such a way that a longitudinal profile thereof has flanks which increase from said center electrode (21) toward said ground electrode (16) and which have a step-like contour.

17. Spark plug according to claim 1, wherein at least said surface (22) of said insulating body consists of fine grained ceramic material.

* * * * *